United States Patent [19]

Suchevits

[11] Patent Number: 4,762,082

[45] Date of Patent: Aug. 9, 1988

[54] ALARM DEVICE

[76] Inventor: Edward E. Suchevits, 114 Mayflower Dr., Uniontown, Pa. 15401

[21] Appl. No.: 129,668

[22] Filed: Dec. 7, 1987

Related U.S. Application Data

[63] Continuation-in-part of Ser. No. 8,583, Jan. 29, 1987, abandoned.

[51] Int. Cl.[4] ..... G08B 13/08

[52] U.S. Cl. ..... 116/87; 116/83; 116/11

[58] Field of Search ..... 116/85–87, 116/11, 15, 17, 83, 95, 100, 67 R; 200/61.62, 61.71, 61.72, 61.73, 61.74, 61.75, 61.76, 61.78, 61.79, 61.80, 61.81; 340/545, 549

[56] References Cited

U.S. PATENT DOCUMENTS

| | | | |
|---|---|---|---|
| 193,210 | 7/1877 | Bailey | 116/83 |
| 364,637 | 6/1887 | Ellwood | 116/87 |
| 1,259,895 | 3/1918 | Monaco et al. | 116/87 |
| 2,281,193 | 4/1942 | Hollingsworth | 200/61.80 |
| 3,996,434 | 12/1976 | Griffin | 200/61.79 |
| 4,130,083 | 12/1978 | Bouchard et al. | 116/87 |

FOREIGN PATENT DOCUMENTS

| | | | |
|---|---|---|---|
| 825826 | 12/1951 | Fed. Rep. of Germany | 116/83 |
| 210935 | 10/1940 | Switzerland | 116/83 |

*Primary Examiner*—William A. Cuchlinski, Jr.
*Assistant Examiner*—Patrick R. Scanlon
*Attorney, Agent, or Firm*—Paul Bogdon

[57] ABSTRACT

An alarm device for use with doors, windows, and the like for causing a loud gunshot-like signal upon unauthorized entry is disclosed. The alarm device includes a compact housing having a chamber therein containing a firing mechanism and a detonatable gas generator cartridge. The cartridge communicates with an opening in the housing whereby when the cartridge is detonated, the gases rush through the opening resulting in a loud gunshot-like report. The chamber of the housing is closed by a movable cover which is constructed to hold the firing mechanism against acting on the cartridge. The housing is shaped for mounting on a door or window surface with the cover engaging the frame of the door or another part of the window, such that when the door or window are opened the cover will move to release the firing mechanism to strike and detonate the cartridge. The alarm device is also provided with a lock to secure the cover from moving until it is desired to activate the device. A safety rod may also be provided to prevent the firing mechanism from being armed until desired.

10 Claims, 3 Drawing Sheets

ALARM DEVICE

RELATIONSHIP TO OTHER PATENT APPLICATIONS

This Patent Application is a continuation-in-part of U.S. patent application Ser. No. 07/008,583, filed Jan. 29, 1987 and now abandoned, in the name of Edward E. Suchevits for Alarm Device.

BACKGROUND OF THE INVENTION

This invention relates to an alarm device for mounting on a door, window, or the like whereby when the door or window is opened without authority to do so a loud gunshot-like signal results, warning building occupants and warding off the trespassers.

Many buildings, rooms, storage facilities, and the like are tied into burglar alarm systems for signaling unauthorized entry to the occupants of the building and sometimes to law enforcement agents. The known alarm systems are somewhat elaborate and expensive. In most instances alarm systems function well to deter burglars and other criminals from entering protected areas. However, the expense of the known alarm systems makes them unavailable to a great number of people who cannot afford them while needing or desiring protection from unlawful entry into their properties. In certain areas where crime rates are high or which are attractive to burglars, the building occupants take all precautions available to them to deter criminal entry into their buildings. The precautions, such as making certain that all doors and windows are locked, are not adequate in providing protection since locks may be picked and window glass silently broken to permit the criminals entry into the buildings by opening the doors or windows. To provide better protection from entry an inexpensive and simply constructed signal or alarm device is needed which would cause a loud signal to result whenever a door or window was opened without permission of the building occupants. Such an alarm device when activated would give positive warning to building occupants of unauthorized entry and would also frighten off would be burglars. An alarm device which would produce a loud gunshot-like signal when activated is desirable since it would give certain notice to the building occupants of unauthorized entry and would disorient and frighten would be burglars so that they would quickly leave. No such alarm device has been heretofore known.

This invention provides an alarm device which is very simply and inexpensively constructed, and which is arranged to be easily mounted on doors, windows, and the like. The alarm device of this invention, when activated, will give a loud gunshot-like signal whenever the door or window to which it is mounted is unlawfully opened. It is also expected that my alarm device may be sold at such a reasonable price to allow it to be disposed of in the event it is activated. As well as providing positive protection my device may be assuredly locked against being operable until it is desired to activate it.

SUMMARY OF THE INVENTION

This invention provides a simply and inexpensively constructed alarm device which may be mounted on doors, windows, and the like, to signal any unauthorized or unlawful movement of those doors or windows. The alarm device of my invention preferably comprises: a generally box shaped housing having an opened first end section and an opposite closed second end section, and a first side section shaped to engage a generally planar surface and an opposite second side section; the housing defines a first chamber therein at one end thereof and in communications with the first end section of the housing, and closed at its other end; the housing also defining a second chamber located in the second end section thereof and having at least one of its ends open; the housing is also provided with at least one passageway communicating between the first and second chambers; a detonatable gas generator cartridge received in the passageway; a firing mechanism supported by the housing within the first chamber and arranged to strike the cartridge when activated; and a cover slidably supported by the housing arranged to engage a planar surface adjacent the first side of the housing for closing the open end of the first chamber and for holding the firing mechanism against striking the cartridge and also for releasing the firing mechanism when the cover is moved a predetermined distance from the originally engaged planar surface. Means for securing the device to a door or frame may be provided and could be simply an adhesive strip or a bracket slidably arrangd on one side of the housing and attachable to a door or window frame. A locking assembly may also be arranged with the housing to selectively lock the cover against movement until it is desired to activate the alarm device. The firing mechanism may be prevented from being placed in its armed position by a securing member supported by the housing of the device.

My alarm device is easily mounted on a door or window without the need of any elaborate procedure, tools, or additional parts. When mounted for use the cover of my device engages the door frame, for example, and is armed by unlocking the cover. The door frame will restrain the cover from moving until the door is attempted to be opened. Slight movement of the door will result in the cover moving to release the firing mechanism to strike the gas generator cartridge. The result is a rapid release of combustion gases and a loud gunshot-like sound.

Various other advantages, details, and modifications of the present invention will become apparent as the following descriptions of certain preferred embodiments proceed.

DESCRIPTION OF THE DRAWINGS

In the accompanying drawings I show certain present preferred embodiments of my invention in which.

DESCRIPTION OF A PREFERRED EMBODIMENT

Figure 1:
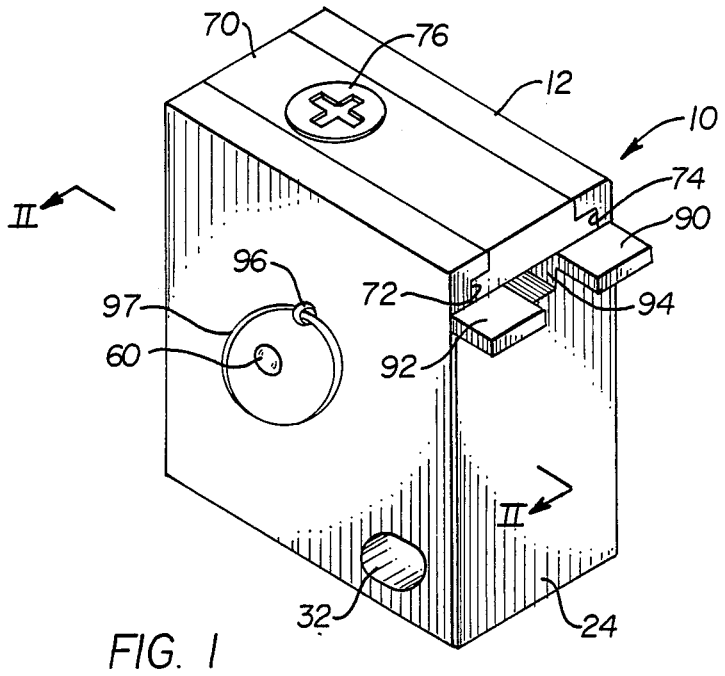
FIG. 1 is a perspective view of an alarm device of my present invention.

Referring now to the drawings there is shown one embodiment of an alarm device 10 embodying my present invention. The alarm device 10 includes a generally box-shaped housing 12 formed preferably of a suitable plastic material and sized to fit in any adult hand. The housing 12 has an opened first end or top section 14 and an opposite closed second end or bottom section 16. The housing 12 also has a flat first side section 18 suitably shaped to engage a generally planar surface such as a door 20 and an opposite second side section 22. Suitably secured to the first side section 18 is a strip of adhesive material 24, shown in a somehwat exaggerated width for illustrative purposes only, for securing the housing 12 to the door 20.

A first or main chamber 30 is formed within housing 12 and has an open top communicating with the opened top section 14 of the housing, and a closed bottom section disposed intermediate the top and bottom sections 14 and 16, respectively, of the housing. A second chamber 32 is provided in the bottom section 16 of the housing 12, and is opened between the faces of the housing. Communicating between the first chamber 30 and the second chamber 32 is an open passageway 34 sized to removably receive a detonatable gas generator cartridge 40 with the detonator thereof facing the open end of the first chamber. A pair of generally parallel channels 42 and 44 also communicate between the first and second chambers 30 and 32. The passageway 34 and channels 42 and 44 permit the high speed flow of combustion gases from the cartridge 40 after it is detonated with the gas flow resulting in a loud gunshot-like signal as it discharges from the second chamber 32.

Figure 2:
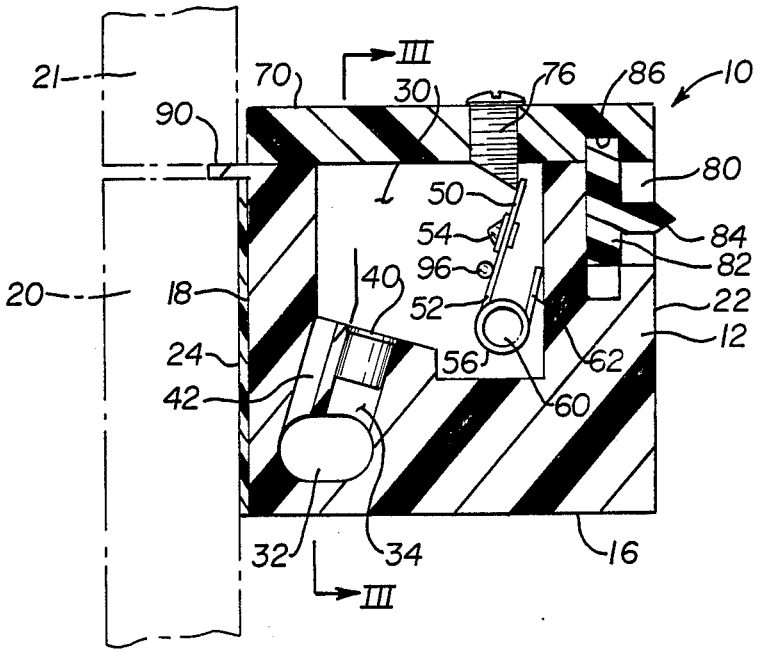
FIG. 2 is an elevation view in section of the alarm device of FIG. 1 showing the firing mechanism in its armed position with the cover locked against movement; and also showing the device mounted on a planar surface such as a door in phantom outline.
Figure 3:
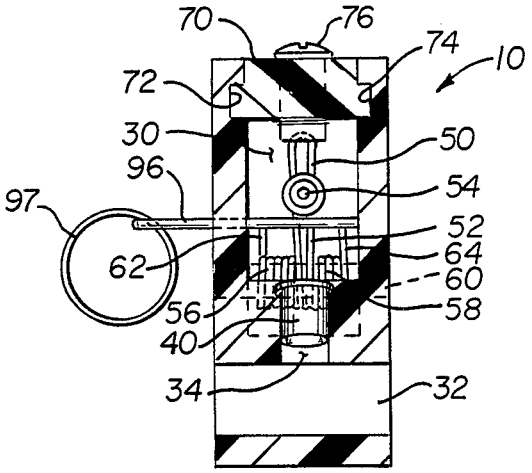
FIG. 3 is a view taken along the line III—III of FIG. 2.
Figure 4:
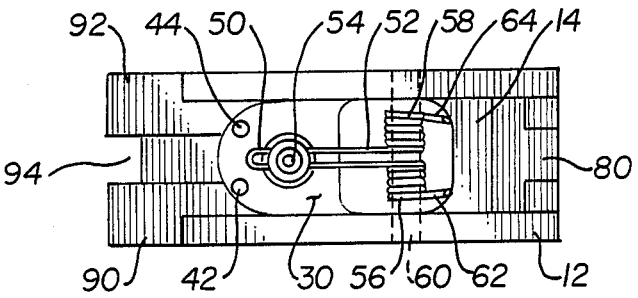
FIG. 4 is a plan view of the alarm device of FIG. 1 with the cover and the locking device removed, and the firing mechanism shown in its struck position, to show details of construction.

Supported by housing 12 and received within the first chamber 30 is a firing mechanism 50 which is formed from a single strand of steel wire. The firing mechanism 50 includes an elongated striker 52 formed in a folded configuration and extending across the gas generator cartridge 40 as shown in FIG. 4. Supported between the legs of the striker 52 is a firing pin 54 which is arranaged to penetrate into the passageway 34 and thus centrally of the cartridge 40. The legs of the striker 52 extend to a pair of juxtaposed coil springs 56 and 58 arranged around a pin 60 supported between the faces of the housing 12. The coil springs 56 and 58 terminate in fingers 62 and 64 which abut on the adjacent wall of the first chamber 30 whereby the fingers 62 and 64, and coil springs 56 and 58 urge a biasing force onto the striker 52 in the direction of the cartridge 40. The striker 52 is pivotable upwardly as shown in FIG. 2 and whenever any restraining force on the striker is removed the striker will be urged downwardly to impress a detonation force on the gas generator cartridge 40.

A closure member or cover 70 is slidably received in slots 72 and 74 provided in the top section 14 of housing 12. The cover 70 is sized to enclose the entire top section 14 of the housing 12 and the open top of the first chamber 30. A cam member 76 is supported by cover 70 and has an inclined end extending below the bottom surface of the cover. The cam member 76 will engage the top of the striker 52 of the firing mechanism 50 to hold the firing mechanism in its armed position, as shown in FIG. 2. The firing mechanism 50 will urge a force on the cover 70 in the direction of the first side section 18 of the housing 12, that is, the side having the adhesive strip 24. Stated differently, the firing mechanism 50 will urge the cover 70 toward the door frame 21 which will abut the end of the cover 70 when the housing 12 is secured to the door 20. Thus, when the door 20 is moved, the cover 70 is also moved toward the door frame 21 resulting in the cover 70 moving under the urging of the firing mechanism 50 and eventually the striker 52 will be released from the restraining hold had on it by the cover 70 through the end of the cam member 76. The striker 52 will pivot down under the force of springs 56 and 58 and fingers 62 and 64 and the firing pin 54 will strike the cartridge 40 with a force sufficient to cause detonation.

A locking means is provided to lock the cover 70 in place until it is desired to activate the alarm device 10. As shown in FIG. 4, a formed slot 80 is provided in the top section 14 on the second side section 22 of the housing 12. Slidably received in the slot 80 is a flat locking piece 82 and a tab 84 is fixed thereon. The upper section of the locking piece 82 is sized to fit into a transverse groove 86 formed in the bottom of the cover 70, as shown in FIG. 2. The cover 70 is simply unlocked by pushing down on the tab 84 to displace the locking piece 82 from the groove 86 of cover 70.

A pair of generally thin flat fingers or mounting tabs 90 and 92 are formed on the top section 14 at the first side section 18 of housing 14, and serve as guides for emplacing the alarm device 10 on a door 20 so that the cover 70 engages the door frame 21. The mounting tabs 90 and 92 will fit into the clearance existing between the door 20 and the door frame 21, as shown in FIG. 2. Separating the mouting tabs 90 and 92 is a slot 94 which allows the cam member 76 to freely enter into the first chamber 30 when assembling the cover 70 with the housing 12.

A security pin 96, with a ring 97 on one end, is slidably received in openings formed in housing 12. The security pin 96 is positioned to either hold firing mechanism 50 against being released when the cover 70 is moved or to prevent the firing mechanism 50 from being armed by restraining the striker 52 against being pivoted to a position to be engaged by the cam member 76 on cover 70. In FIG. 2, the security pin 96 is shown abutting the striker 52 to hold the firing mechanism 50 in an inactive position. The security pin 96 is simply removed from the housing 12 by pulling it out with the aid of the ring 97.

In using my alarm device 10, it is simply secured by the adhesive strip 24 to the protected object such as door 20 whereby the cover 70 abuts the door frame 21 which prevents the cover 70 from moving so long as the door is shut. Opening the door 20 moves the alarm device 10 and the restraint of the door frame 21 on the cover 70 which in turn moves, releasing the striker 52 of the firing mechanism 50, the striker 52 pivoting with a significant force whereby the firing pin 54 strikes the detonator of the gas generator cartridge 40. A loud gunshot-like sound results. Prior to arming the alarm device 10, the cover is unlocked by separating the locking piece 82 from the cover 70, and the security pin 96 is removed from the housing.

Figure 5:
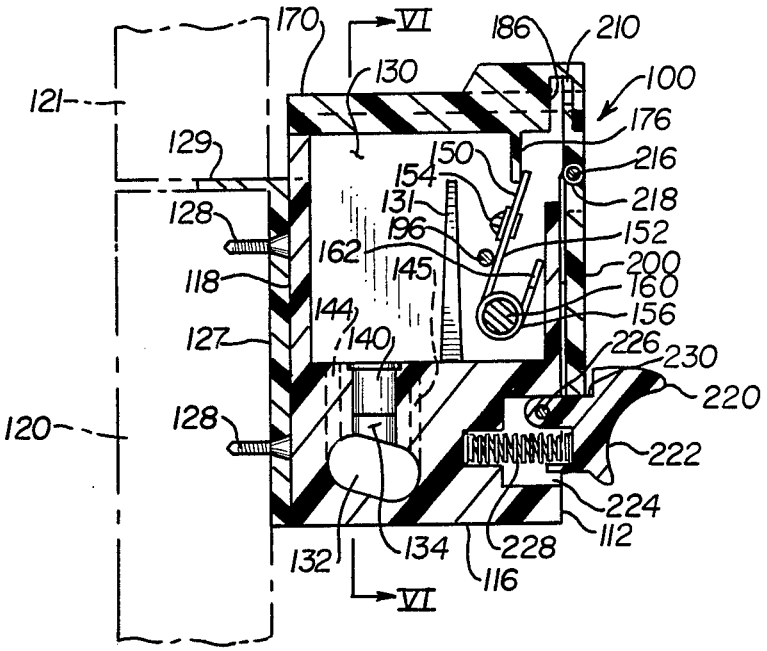
FIG. 5 is an elevation view in section of another embodiment of an alarm device of my present invention showing the firing mechanism in its armed position with the cover locked against movement; and also showing the device mounted on a door frame in phantom outline.
Figure 6:
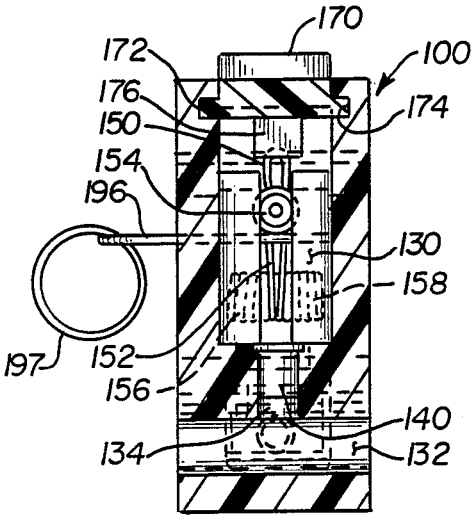
FIG. 6 is a view taken along the line VI—VI of FIG. 5.
Figure 7:
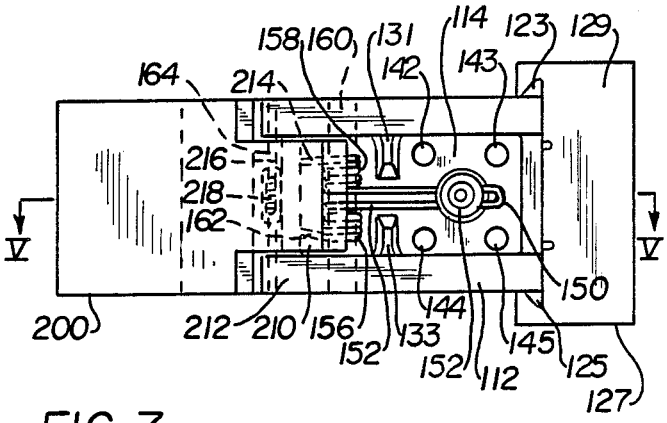
FIG. 7 is a plan view of the alarm device of FIG. 6 with the cover removed and the locking plate shown pivoted outwardly of the alarm body, and the firing mechanism shown in its struck position, to show details of construction.

FIGS. 5 through 7 show another embodiment of the alarm device 100 of my present invention. Alarm device 100 functions essentially the same as the alarm device 10 previously described, and includes a generally box-shaped housing 12 formed preferably of a suitable plastic material and sized to fit in any adult hand. The housing 112 has an opened first end or top section 114 and an opposite closed second end or bottom section 116. The housing 112 also has a flat first side section 118 and an opposite second side section 122. The first side section 118 includes a pair of oppositely arranged, longitudinally extending ribs 123 and 125, as shown in FIG. 7. Slidably secured to the first side section 118 of the housing 112 is a generally planar mounting plate 127 suitably sized and shaped to be secured as with wood screws 128 to a door 120. The mounting plate 127 also includes a transversely extending tab 129 at one end thereof sized and shaped to fit into the clearance existing between the door 120 and door frame 121, as shown in FIG. 5. The housing 112 is simply secured to or removed from the mounting plate 127 which may be kept permanently in the door 120.

A first or main chamber 130 is formed within housing 112 and has an open top communicating with the opened top section 114 of the housing 112, and a closed bottom section disposed intermediate the top and bottom sections 114 and 116, respectively, of the housing. A second chamber 132 is provided in the bottom section 116 of the housing 112, and is opened between the side faces of the housing. Communicating between the first chamber 130 and the second chamber 132 is an open passageway 134 sized to removably receive a detonatable gas generator cartridge 140 with the detonator thereof facing the open end of the first chamber. Four generally parallel channels 142, 143, 144, and 145 also communicate between the first and second chamber 130 and 132. The passageway 134 and channels 142, 143, 144, and 145 also communicate speed flow of combustion gases from the cartridge 140 after it is detonated, with the gas flow resulting in a loud gunshot-like signal as it discharges from the second chamber 132.

Supported by housing 112 and received within the first chamber 130 is a firing mechanism 150 which is formed from a single strand of steel wire. The firing mechanism 150 includes an elongated striker 152 formed in a folded configuration and extending across the gas generator cartridge 140. Supported between the legs of the striker 152 is a firing pin 154 which is arranged to penetrate into the passageway 134 and thus centrally of the cartridge 140. Provided with chamber 130 is a pair of identically shaped, transversely spaced, upwardly extending legs 131 and 133 which serve to center the stricker 152 to insure alignment with the cartridge 140. The legs of the striker 152 extend to a pair of juxtaposed coil springs 156 and 158 arranged around a pin 160 supported between the faces of the housing 112. The coil springs 156 and 158 terminate in fingers 162 and 164 which abut the adjacent wall of the first chamber 130 whereby the fingers 162 and 164, and coil springs 156 and 158 urge a bearing force onto the stroker 152 in the direction of the cartridge 140.

A cover 170 is slidably received in slots 172 and 174 provided in the top section 114 of housing 112. The cover 170 is sized to enclose the entire top section 114 of the housing 112 and the open top of the first chamber 130. A cam member 176 is supported by cover 170. The cam member 176 will engage the tip of striker 152 of the firing mechanism 150 to hold the firing mechanism in its armed position, as shown in FIG. 5. The firing mechanism 150 will urge the cover 170 toward the door frame 121 which will abut the end of the cover 170 when the housing 112 is secured to the mounting plate 127, and the firing mechanism 150 is in its unlocked, armed position. When door 120 is moved, the cover 170 is also moved toward the door frame 121 resulting in the cover 170 moving under the urging of the firing mechanism 150 and eventually the striker 152 will be released from the restraining hold had on it by cover 170 through the end of the cam member 176. The striker 152 will pivot down under the force of springs 156 and 158 and the firing pin 154 will strike the cartridge 140 with a force sufficient to cause detonation.

The cover 170 is locked in place until it is desired to activate the alarm device 100. There is provided a flat locking plate 200 having an upper tab 210 with its free upper end sized to be received into a transverse groove 186 formed on the underside of cover 170. The locking plate 200 is pivotably arranged in an opening between arms 212 and 214 formed integrally on the second side section 122 of housing 112. A pivot pin 216 extends between the arms 212 and 214 and through a suitable opening formed through the upper tab 210 of the locking plate 200. A helical coil spring 218 is arranged on the central portion of the pivot pin 216, with the spring having its ends engaging the undersurface of the locking plate 200 and the second end section 122 of the housing 112. The spring 218 urges an upwardly directed force on the locking plate 200 to pivot it away from housing 112 whenever it is free from restraint. As shown in FIG. 7, when the locking plate 200 is pivoted away from housing 112 it is free of engagement with cover 170 which is thereby free to move and as a result the alarm device 100 is armed. A restrainer 220 holds the locking plate 200 in its cover-locking relationship with cover 170. The restrainer includes a main body 222 having an end section arranged in a cavity 224 formed in a lower region of the second end section 122 of housing 112. A pivot pin 226 extends between the sides of the cavity 224 to secure the main body 222 in the cavity and to allow for limited pivotable movement of the body towards and away from the housing 112. An outwardly directed helical coil spring 228 is arranged in an opening in the cavity 224 to engage the inner region of the main body 222 to urge an outwardly directed pivoting force on the main body 222. The main body 222 is also provided with a slot 230 between the upper sections of its sides, the slot being shaped to receive the lower end of the locking plate 200, as shown in FIG. 5. By pressing down on the main body 222 it will pivot away from housing 112 to release the locking plate 200 from its restraint and in turn the locking plate will pivot outwardly to unlock cover 170. Pushing down on the locking plate 200 will result in the plate urging an inward pivoting force on the main body 222 and a capture of the lower end of the locking plate to hold it in its locking arrangement with cover 170 when the tab 210 enters into slot 186 of the cover.

A security pin 196, with a ring 197 on one end, is slidably received in openings formed in housing 112. The security pin 196 is positioned to either hold firing mechanism 150 against being released when the cover 170 is moved or to prevent the firing mechanism 150 from being armed by restraining the striker 152 against being pivoted to a position to be engaged by the cam 176 on cover 170. In FIG. 5, the security pin 196 is shown abutting the striker 152 to hold the firing mechanism 150 in an inactive position. The security pin 196 is simply removed from the housing 112 by pulling it out with the aid of the ring 197.

It should now be clearly apparent to those skilled in this art that my alarm device 10 and 100 have the advantages described in the introductory section of this Specification. My alarm devices 10 and 100 may be inexpensively produced, are simple to use, and are very effective in obtaining protection from unauthorized or unlawful entry into a building. Since the alarm device of my invention is capable of being sold very inexpensively it can be marketed as a disposable device.

While I have shown and described present preferred embodiments of this invention, it is to be distinctly understood that the invention is not limited thereto, but may be otherwise embodied within the scope of the following claims.

I claim:

1. An alarm device, comprising:

a generally boxed-shaped housing having an opened first end section and an opposite closed second end section, and having a first side section shaped to engage a generally first planar surface and an opposed second side section;

said housing defining a first chamber therein open at one end thereof and in communication with said first end section of said housing, and closed at its other end;

said housing defining a second chamber located in said second end section thereof and having at least one of its ends open;

said housing having at least one passageway communicating between said first chamber and said second chamber;

said housing defining at least one open channel communicating between said first and second chambers;

detonatable gas generator means received in said passageway;

firing mechanism means supported by said housing within said first chamber for impressing a detonating force on said gas generator means; and closure means slideably supported by said housing arranged to engage a generally second planar surface coplanar with said first planar surface and adjacent said first side section of said housing for closing said one end of said first chamber and for holding said firing mechanism means against striking said gas generator means and for releasing said firing mechanism means when said closure means is moved a predetermined distance from said first planar surface.

2. The alarm device as set forth in claim 1 wherein said closure means includes a cam element thereon engageable with said firing means for holding and releasing said firing mechanism means.

3. The alarm device as set forth in claim 1 wherein said firing mechanism means includes a striker member pivotably supported by said housing within said first chamber; a spring member operatively engaging said striker member to urge a force thereon in the direction of said gas generator means; and wherein said closure means engages said striker member for holding and releasing said firing mechanism means; and wherein said striker member and spring member are constructed and arranged such that said striker member will strike said gas generator means when said closure means releases said firing mechanism means.

4. The alarm device as set forth in claim 1 including selectively operable locking means supported by said housing for locking said closure means against any movement thereof and for releasing said closure means for movement.

5. The alarm device as set forth in claim 1 including securing means removably supported by said housing for engaging firing mechanism means for selectively preventing said firing mechanism means to be placed in a position impressing a detonating force on said gas generating means or for restraining said firing mechanism means from being released.

6. The alarm device as set forth in claim 1 wherein said second chamber in said housing has both ends open to define an unobstructed opening through the housing.

7. The alarm device as set forth in claim 1 including mounting means supported by said housing for fixing said housing on said first planar surface in such a position that said closure means engages said second planar surface adjacent said first side section of said housing.

8. The alarm device as set forth in claim 1 including centering means arranged within said first chamber for aligning said firing mechanism means with said detonable gas generator means.

9. The alarm device as set forth in claim 4 wherein said locking means includes a locking plate pivotably supported by said housing to engage said closure means, and a restrainer operable with said locking plate and arranged on said housing to selectively release said locking plate from engagement with said closure means.

10. The alarm device as set forth in claim 7 wherein said mounting means includes a mounting plate slideably secured to said housing, and means for securing said mounting plate to said first planar surface.

* * * * *